US006846384B2

(12) United States Patent
Lindgren et al.

(10) Patent No.: US 6,846,384 B2
(45) Date of Patent: Jan. 25, 2005

(54) PROCESS FOR SIZING PAPER

(75) Inventors: Erik Lindgren, Bohus (SE); Sten Frölich, Askim (SE); Michael Persson, Västra Frölunda (SE)

(73) Assignee: Akzo Nobel N.V., Ahnhem (NL)

( * ) Notice: Subject to any disclaimer, the term of this patent is extended or adjusted under 35 U.S.C. 154(b) by 122 days.

(21) Appl. No.: 09/923,094

(22) Filed: Aug. 6, 2001

(65) Prior Publication Data

US 2002/0100567 A1 Aug. 1, 2002

Related U.S. Application Data

(60) Provisional application No. 60/249,365, filed on Nov. 16, 2000, provisional application No. 60/223,367, filed on Aug. 7, 2000, provisional application No. 60/223,368, filed on Aug. 7, 2000, and provisional application No. 60/223,369, filed on Aug. 7, 2000.

(30) Foreign Application Priority Data

| | | |
|---|---|---|
| Aug. 7, 2000 | (EP) | 00850135 |
| Aug. 7, 2000 | (EP) | 00850136 |
| Aug. 7, 2000 | (EP) | 00850137 |
| Nov. 16, 2000 | (EP) | 00850195 |

(51) Int. Cl.[7] ..... D21H 21/16

(52) U.S. Cl. ..... 162/158; 162/163; 162/164.1; 162/164.5; 162/164.6; 162/165; 162/168.1; 162/168.2; 162/168.3; 162/175; 162/183

(58) Field of Search ..... 162/158, 164.1, 162/164.6, 168.1, 168.2, 168.3, 164.5, 165, 163, 183; 167/175

(56) References Cited

U.S. PATENT DOCUMENTS

| | | | | |
|---|---|---|---|---|
| 3,887,427 | A | 6/1975 | Helmer et al. | 162/158 |
| 4,070,236 | A | 1/1978 | Carrard et al. | 162/164 R |
| 4,687,519 | A | 8/1987 | Trzasko et al. | 106/211 |
| 5,098,520 | A | 3/1992 | Begala | 162/168.1 |
| 5,538,596 | A | 7/1996 | Satterfield et al. | 162/164.5 |
| 5,595,629 | A | 1/1997 | Begala | 162/158 |
| 5,755,930 | A | 5/1998 | Satterfield et al. | 162/164.1 |
| 5,972,094 | A | 10/1999 | Bates et al. | 106/145.1 |
| 6,001,166 | A | 12/1999 | Ettl et al. | 106/287.2 |
| 6,022,449 | A | 2/2000 | Jansen et al. | 162/135 |
| 6,074,468 | A | 6/2000 | Bates et al. | 106/145.1 |

FOREIGN PATENT DOCUMENTS

| | | | |
|---|---|---|---|
| EP | 0 056 876 A1 | 8/1982 | C08L/93/04 |
| EP | 0 189 935 A 2 | 8/1986 | C08B/11/193 |
| EP | 0 525 751 A1 | 2/1993 | C08F/20/60 |
| EP | 0 805 234 A2 | 11/1997 | D21H/23/14 |
| EP | 0 984 101 A1 | 3/2000 | D21H/17/18 |
| WO | WO 94/24169 | 10/1994 | C08B/11/15 |
| WO | WO 95/21296 | 8/1995 | D21H/17/53 |
| WO | WO 98/33979 | 8/1998 | D21H/17/71 |
| WO | WO 98/33980 | 8/1998 | D21H/17/71 |
| WO | WO 98/33982 | 8/1998 | D21H/17/72 |
| WO | WO 99/55962 | 11/1999 | |
| WO | WO 99/55964 | 11/1999 | D21H/23/04 |
| WO | WO 99/55965 | 11/1999 | D21H/23/08 |
| WO | WO 00/06490 | 2/2000 | C01B/33/14 |
| WO | WO 00/23651 | 4/2000 | D21H/17/72 |
| WO | WO 00/49227 | 8/2000 | D21H/21/10 |

*Primary Examiner*—Peter Chin
(74) *Attorney, Agent, or Firm*—Richard P. Fennelly; Michelle J. Burke

(57) ABSTRACT

A process for sizing paper comprising adding to an aqueous suspension containing cellulosic fibers, and optional fillers, an anionic or cationic sizing dispersion, and a sizing promoter comprising a cationic organic polymer having an aromatic group; and an anionic polymer having an aromatic group selected from step-growth polymers, polysaccharides and naturally occurring aromatic polymers, wherein the sizing dispersion and sizing promoter are added separately to the aqueous suspension.

78 Claims, No Drawings

PROCESS FOR SIZING PAPER

This application claims priority under 35 USC 119(e) to U.S. provisional patent applications: 60/249,365 filed Nov. 16, 2000; 60/223,367 filed Aug. 7, 2000; 60/223,368 filed Aug. 7, 2000; and 60/223,369 filed Aug. 7, 2000.

The present invention refers to a process for sizing paper which comprises adding to a suspension containing cellulosic fibres, and optional fillers, an anionic or cationic sizing dispersion, and a sizing promoter comprising a cationic organic polymer having one or more aromatic groups; and an anionic polymer having one or more aromatic groups being a step-growth polymer, a polysaccharide and a naturally occurring aromatic polymer, forming and draining the obtained suspension, wherein the sizing dispersion and sizing promoter are added separately to the aqueous suspension.

BACKGROUD

Dispersions or emulsions of sizing agents are used in papermaking in order to give paper and paper board improved resistance to wetting and penetration by various liquids. The sizing dispersions are usually added to an aqueous suspension containing cellulosic fibres, optional fillers and various additives. The aqueous suspension is fed into a headbox ejecting the suspension onto a wire where a wet web of paper is formed. To the suspension is further commonly added compounds such as starches and microparticulate materials which facilitate the dewatering of the suspension on the wire. The water drained from the wire, referred to as white water, is usually partly recirculated in the papermaking process. The cellulosic suspension contains a certain amount of non-fibrous material, for example fillers, charged polymers, sizing agents and various charged contaminants, i.e. anionic trash, electrolytes, colloidal substances, etc. The non-fibrous material has an influence on the sizing efficiency and commonly impairs the sizing efficiency. High amounts of charged compounds such as high contents of salts in the suspension renders a suspension which is increasingly difficult to size, i.e. to obtain a paper with satisfactory sizing properties. Other compounds contained in the suspension which deteriorates sizing are various lipophilic wood extractives which may come from recycled fibres and mechanical pulps. An increased amount of added sizing agent often improve sizing, however, leading to higher costs as well an increased accumulation of sizing agents in the white water. The accumulation of non-fibrous material as well as any other component present in the suspension will be even more pronounced in mills where white water is extensively recirculated with the introduction of only low amounts of fresh water into the papermaking process. Thus, it is an objective of the present invention to further improve sizing. Another objective of the present invention is to improve sizing when sizing aqueous cellulosic containing suspensions having high conductivity ans/or high amounts of lipophilic wood extractives. Yet further objectives will appear hereinafter.

U.S. Pat. No. 6,001,166 refers to aqueous alkyl diketen dispersions containing cationic starch and anionic dispersants such as lignin sulphonic acids, condensates of naphthalenesulphonic acid and formaldehyde.

WO 0023651 relates to anionic and cationic sizing dispersions containing ketene dimers and at least an anionic dispersing agent.

EP 984101 discloses sizing compositions comprising ketene dimers or acid anhydrides and a complexing agent selected from aminopolycarboxylic acids, N-bis- or tris-((1.2-dicraboxylethoxy)ethyl)amines and phosphonic acids.

U.S. Pat. No. 5,972,094 refers to sizing compositions comprising a thermoplastic resin selected from the group consisting of thermoplastic rosins, thermoplastic hydrocarbon resins, thermoplastic polyamides and thermoplastic amide waxes.

U.S. Pat. No. 5,595,629 discloses a paper making process comprising forming an aqueous cellulosic paper making slurry and adding a cationic polymer and an anionic polymer to the slurry to increase retention and/or drainage. The anionic polymer comprises a formaldehyde condensate of a naphthalene sulfonic acid salt.

Invention

It has been found that the invention according to the claims surprisingly solves the problems outlined in the application. More specifically, the invention relates to a process for sizing paper which comprises adding to an aqueous suspension containing cellulosic fibres, and optional fillers, an anionic or cationic sizing dispersion, and a sizing promoter comprising a cationic organic polymer having one or more aromatic groups and an anionic polymer having one or more aromatic groups being a step-growth polymer, a polysaccharide or a naturally occurring aromatic polymer, forming and draining the obtained suspension, wherein the sizing dispersion and sizing promoter are added separately to the aqueous suspension.

Sizing Dispersion

The sizing agent comprised in the anionic or cationic sizing dispersion used in the process according to the present invention is suitably any sizing agent rendering paper or board with enhanced resistance to wetting and penetration of liquids, such as non-cellulose-reactive agents including rosins, e.g. fortified and/or esterified rosins, waxes, fatty acids and resin acid derivatives, e.g. fatty amides and fatty esters, e.g. glycerol triesters of natural fatty acids, and/or cellulose-reactive agents. Preferably, the sizing dispersion contains cellulose-reactive sizing agents. The cellulose-reactive sizing agents comprised in the sizing dispersion can be selected from any cellulose-reactive agents known in the art. Suitably, the sizing agent is selected from hydrophobic ketene dimers, ketene multimers, acid anhydrides, organic isocyanates, carbamoyl chlorides and mixtures thereof, preferably ketene dimers and/or acid anhydrides. Suitably the ketene dimers have the general formula (I) below, wherein $R^1$ and $R^2$ represent saturated or unsaturated hydrocarbon groups, usually saturated hydrocarbons, the hydrocarbon groups suitably having from 8 to 36 carbon atoms, usually being straight or branched chain alkyl groups having 12 to 20 carbon atoms, such as hexadecyl and octadecyl groups. The ketene dimers can be liquid at ambient temperature, i.e. at 25° C., suitably at 20° C. Commonly, the acid anhydrides can be characterised by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, optionally being further substituted with hydro-carbon groups containing up to 30 carbon atoms. Examples of acid anhydrides which are used commercially include alkyl and alkenyl succinic anhydrides and particularly isoocta-decenyl succinic anhydride.

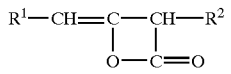

(I)

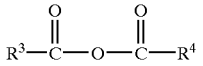

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

The process according to the present invention comprises adding to a suspension containing cellulosic fibres an anionic or cationic aqueous sizing dispersion, i.e. the dispersing and/or stabilising agents present in the dispersion which can be referred to as the dispersing system have an overall anionic or cationic charge, respectively. The dispersing system can include any agent facilitating the formation of a dispersion or emulsion such as dispersing and/or stabilising agents exemplified by polyelectrolytes, surfactants and electrolytes. Anionic aqueous sizing dispersions may comprise cationic compounds, i.e. cationic polyelectrolytes (cationic or amphoteric polyelectrolytes with an overall cationic charge) and/or cationic surfactants and/or any other cationic compound known to the skilled person provided that the overall charge of the dispersing system is anionic. Cationic aqueous sizing dispersions, on the other hand, can comprise anionic compounds, i.e. anionic polyelectrolytes (anionic or amphoteric polyelectrolytes with an overall anionic charge) and/or anionic surfactants and/or any other anionic compound known to the skilled person provided that the overall charge of the dispersing system is anionic. The anionic or cationic charge of the sizing dispersion can be determined by means of a ZetaMaster S version PCS.

According to a preferred embodiment of the present invention the anionic or cationic sizing dispersion contains a cationic organic polymer having one or more aromatic groups or/and an anionic polymer having one or more aromatic groups. The cationic organic polymer and the anionic polymer can be any of those described hereinafter comprised in the sizing promoter.

The anionic or cationic sizing dispersion added to the suspension can have a sizing agent content from 0.1 to 50% by weight based on total dispersion/emulsion, suitably over 20% by weight. Dispersions comprising ketene dimer sizing agents may have ketene dimer contents from 5 up to 50% by weight based on total dispersion, preferably from 10 up to 35% by weight. Dispersions, or emulsions, comprising acid anhydride sizing agents may have acid anhydride contents from 0.1 up to 30% by weight based on total dispersion/emulsion, suitably from 1 up to 20% by weight. Dispersions containing non-cellulose reactive sizing agents suitably have sizing agent contents from 5 up to 50% by weight, preferably from 10 up to 35% by weight. If an anionic and/or a cationic polymer having one or more aromatic groups are comprised in the sizing dispersion they are suitably present in an amount of from about 0.1% by weight up to about 15% by weight based on sizing agent.

The amount of sizing agent added to the aqueous suspension containing cellulosic fibres can be from 0.01 to 5% by weight, suitably from 0.05 to 1.0% by weight, based on dry weight of cellulosic fibres and optional fillers, where the dosage is dependent on the quality of the pulp or paper to be sized, the sizing agent and the level of sizing.

According to the present invention an anionic or cationic sizing dispersion and a sizing promoter comprising a cationic organic polymer having one or more aromatic groups and an anionic polymer having one or more aromatic groups being a step-growth polymer, a polysaccharide or a naturally occurring aromatic polymer are added separately to the aqueous suspension. Although the sizing dispersion may contain the same polymers as comprised in the sizing promoter, significant improvements regarding sizing, is only observed when the sizing promoter and the sizing dispersion are added separately to the cellulosic suspension. By separate addition is meant that the sizing dispersion which may comprise any of the polymers of the sizing promoter and the sizing promoter are added at different locations to the cellulosic suspension (thin stock) or at substantially the same location but timely separated. Furthermore, the cationic organic polymer and the anionic polymer forming the sizing promoter are suitably also added separately. Preferably, the anionic polymer is added to the suspension after both the sizing dispersion and the cationic organic polymer.

According to a preferred embodiment of the present invention the process for sizing paper comprises adding to an aqueous suspension containing cellulosic fibres, and optional fillers, an anionic or cationic sizing dispersion comprising a sizing agent and an anionic polymer having one or more aromatic groups being a step-growth polymer, a polysaccharide or a naturally occurring aromatic polymer, the amount of added sizing agent to the suspension being from about 0.01% up to about 5.0% by weight based on dry fibres; and a sizing promoter comprising a cationic polymer having one or more aromatic groups being suitably a cationic polysaccharide or a cationic vinyl addition polymer, and an anionic polymer having one or more aromatic groups being a step-growth polymer, a polysaccharide or a naturally occurring aromatic polymer, the amount of cationic polymer added to the suspension being from about 0.001% up to about 3.0% by weight based on dry fibres, and the amount of anionic polymer added to the suspension being from about 0.001% up to about 3.0% by weight based on dry fibres, forming and draining the obtained suspension, wherein the sizing dispersion and the sizing promoter are added separately to the aqueous suspension.

According to yet another preferred embodiment of the invention the anionic or cationic sizing dispersion comprises a sizing agent, a cationic organic polymer having one or more aromatic groups, such as a cationic polysaccharide or a cationic vinyl addition polymer, and an anionic polymer having one or more aromatic groups being a step-growth polymer, a polysaccharide or a naturally occurring aromatic polymer suitably the anionic polymer being a step-growth polymer or a naturally occurring aromatic polymer.

Suitably, the cationic polymer having one or more aromatic groups is a cationic polysaccharide having the structural formula (I):

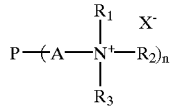

(I)

wherein P is a residue of a polysaccharide; A is a chain of atoms comprising C and H atoms attaching N to the polysaccharide residue, $R_1$and $R_2$ are each H or a hydrocarbon group, $R_3$ is an aromatic hydrocarbon group, n is an integer from 2 up to 300000, and $X^-$ is an anionic counter ion; or vinyl addition polymer obtained by polymerising a cationic monomer or a monomer mixture comprising a cationic monomer represented by the general formula (II):

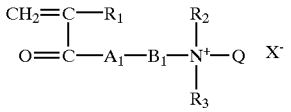

(II)

wherein $R_1$ is H or $CH_3$; $R_2$ and $R_3$ are each an alkyl group having from 1 to 3 carbon atoms, $A_1$ is O or NH, $B_1$ is an alkylene group having from 2 to 8 carbon atoms or a hydroxy propylene group, Q is a substituent containing an aromatic group, and $X^-$ is an anionic counterion. More preferably, the cationic polymer having one or more aromatic groups is a cationic polysaccharide having the structural formula (I):

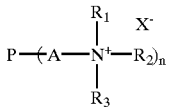

(I)

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion.

Cationic Organic Polymer Having One or More Aromatic Groups

The cationic organic polymer of the sizing promoter and suitably present in the sizing dispersion can be derived from natural or synthetic sources, and can be linear, branched or cross-linked. Preferably the cationic polymer is water-soluble or water-dispersable. Examples of suitable cationic polymers include cationic polysaccharides, e.g. starches, guar gums, celluloses, chitins, chitosans, glycans, galactans, glucans, xanthan gums, pectins, mannans, dextrins, preferably starches and guar gums, suitable starches including potato, corn, wheat, tapioca, rice, waxy maize, barley, etc.; cationic synthetic organic polymers such as cationic chain-growth polymers, e.g. cationic vinyl addition polymers like acrylate-, acrylamide- and vinylamide-based polymers, and cationic step-growth polymers, e.g. cationic polyurethanes. Cationic organic polymers selected from polysaccharides, i.e. starches, and cationic vinyl addition polymers like acrylamide-based polymers having an aromatic group are particularly preferred.

The aromatic group of the cationic organic polymer can be present in the polymer backbone or in a substituent group that is attached to the polymer backbone (main chain), preferably in a substituent group. Examples of suitable aromatic groups include aryl, aralkyl and alkaryl groups, e.g. phenyl, phenylene, naphthyl, xylylene, benzyl and phenylethyl; preferably benzyl, nitrogen-containing aromatic (aryl) groups, e.g. pyridinium and quinolinium, as well as derivatives of these groups. Examples of cationically charged groups that can be present in the cationic polymer as well as in monomers used for preparing the cationic polymer include quaternary ammonium groups, tertiary amino groups and acid addition salts thereof.

According to a preferred embodiment the cationic organic polymer having an aromatic group is selected from cationic polysaccharides. The aromatic group of the polysaccharide can be attached to a heteroatom, e.g. nitrogen or oxygen, present in the polysaccharide, the heteroatom optionally being charged, for example when it is a nitrogen. The aromatic group can also be attached to a group comprising a heteroatom, e.g. amide, ester or ether, which groups can be attached to the polysaccharide backbone(main-chain), for example via a chain of atoms. Example of suitable aromatic groups and groups comprising an aromatic group include aryl and aralkyl groups, e.g. phenyl, phenylene, naphthyl, phenylene, xylylene, benzyl and phenylethyl; nitrogen-containing aromatic (aryl) groups, e.g. pyridinium and quinolinium, as well as derivatives of these groups where one or more substituents attached to said aromatic groups can be selected from hydroxyl, halides, e.g. chloride, nitro, and hydrocarbon groups having from 1 to 4 carbon atoms Preferably, the cationic organic polymer is selected from cationic polysaccharides having the general structural formula (I):

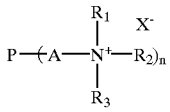

(I)

wherein P is a residue of a polysaccharide; A is a group attaching N to the polysaccharide residue, suitably a chain of atoms comprising C and H atoms, and optionally 0 and/or N atoms, usually an alkylene group with from 2 to 18 and suitably 2 to 8 carbon atoms, optionally interrupted or substituted by one or more heteroatoms, e.g. O or N, e.g. an alkyleneoxy group or hydroxy propylene group (—$CH_2$—CH(OH)—$CH_2$ —); $R_1$ and $R_2$ are each H or, preferably, a hydrocarbon group, suitably alkyl, having from 1 to 3 carbon atoms, suitably 1 or 2 carbon atoms; $R_3$ is suitably an aromatic hydrocarbon group including aralkyl groups, e.g. benzyl and phenylethyl groups; n is an integer from about 2 to about 300,000, suitably from 5 to 200,000 and preferably from 6 to 125,000 or, alternatively, $R_1$, $R_2$ and $R_3$ together with N form a aromatic group containing from 5 to 12 carbon atoms; and $X^-$ is an anionic counterion, usually a halide like chloride.

The aromatic group modified cationic polysaccharide can have a degree of substitution varying over a wide range; the degree of cationic substitution ($DS_C$) can be from 0,01 to 0,5, suitably from 0,02 to 0,3, preferably from 0,025 to 0,2, the degree of aromatic substitution ($DS_{Ar}$) can be from from 0,01 to 0,5, suitably from 0,02 to 0,3, preferably from 0,025 to 0,2, and the degree of anionic substitution ($DS_A$) can be from 0 to 0,2, suitably from 0 to 0,1, preferably from 0 to 0,05.

The polysaccharides can be prepared by subjecting a polysaccharide to cationic and aromatic modification in known manner using one or more agents containing a cationic group and/or a aromatic group, for example by reacting the agent with the polysaccharide in the presence of an alkaline substance such as an alkali metal or alkaline earth metal hydroxide. The polysaccharide to be subjected to cationic and aromatic modification can be non-ionic, anionic, amphoteric or cationic. Suitable modifying agents include non-ionic agents such as, for example aralkyl halides, e.g. benzyl chloride and benzyl bromide; the reaction products of epichlorohydrin and dialkylamines having at least one substituent comprising an aromatic group as defined above, including 3-dialkylamino-1,2-epoxypropanes; and cationic agents such as, for example, the reaction product of epichlorohydrin and tertiary amines having at least one substituent comprising an aromatic group as defined above, including alkaryldialkylamines, e.g. dimethylbenzylamine; arylamines, e.g. pyridine and quinoline. Suitable cationic agents of this type include 2,3-epoxypropyl trialkylammonium halides and halohydroxypropyl trialkylammonium halides, e.g. N-(3-chloro-2-hydroxypropyl)-N-(hydrophobic alkyl)-N,N-di(lower alkyl)ammonium chloride and N-glycidyl-N-(hydrophobic alkyl)-N,N-di(lower alkyl)ammonium chloride where the aromatic group is as defined above, notably octyl, decyl and dodecyl, and the lower alkyl is methyl or ethyl; and halo-hydroxypropyl-N,N-dialkyl-N-alkarylammonium halides and N-glycidyl-N-(alkaryl)-N,N-dialkylammonium chloride, e.g. N-(3-chloro-2-hydroxypropyl)-N-(alkaryl)-N,N-di(lower alkyl) ammonium chloride where the alkaryl and lower alkyl groups are as defined above, particularly N-(3-chloro-2-hydroxypropyl)-N-benzyl-N,N-dimethylammonium chloride; and N-(3-chloro-2-hydroxypropyl) pyridinium chloride. Generally, when using a non-ionic aromatic agent, the polysaccharide is suitably rendered cationic by using any of the cationic agents known in the art before or after the hydrophobic modification. Examples of suitable cationic and/or aromatic modifying agents, aromatic group modified polysaccharides and methods for their preparation include those described in U.S. Pat. Nos. 4,687,519 and 5,463,127; International Patent application WO 94/24169, European Patent Application No. 189 935; and S. P. Patel, R. G. Patel and V. S. Patel, Starch/Stärke, 41(1989), No. 5, pp. 192-196, the teachings of which are hereby incorporated herein by reference.

According to yet another preferred embodiment the cationic organic polymer is selected from homopolymers and coplymers prepared from one or more monomers comprising at least one monomer having an aromatic group, suitably an ethylenically unsaturated monomer. The synthetic polymer may be branched linear or branched. The aromatic group of the synthetic polymer can be present in the polymer backbone or, preferably, it can be a pendant group attached to or extending from the polymer backbone or be present in a pendent group that is attached to or extending from polymer backbone. Suitable aromatic (aryl) groups include those comprising a phenyl group, optionally substituted, a phenylene group, optionally substituted, and a naphthyl group, optionally substituted, for example groups having the general formulae $—C_6H_5$, $—C_6H_4—$, $—C_6H_3—$, and $—C_6H_2—$, e.g. in the form of phenylene ($—C_6H_4—$), xylylene ($—CH_2—C_6H_4—CH_2—$), phenyl ($—C_6H_5$), benzyl ($—CH_2—C_6H_5$), phenethyl ($—CH_2CH_2—C_6H_5$), and substituted phenyl (for example $—C_6H_4—Y$, $—C_6H_3Y_2$, and $—C_6H_2Y_3$) where one or more substituents (Y) attached to the phenyl ring can be selected from hydroxyl, halides, e.g. chloride, nitro, and hydrocarbon groups having from 1 to 4 carbon atoms.

Preferably, the cationic polymer is a vinyl addition polymer. The term "vinyl addition polymer" as used herein, refers to a polymer prepared by addition polymerisation polymerization of one or more vinyl monomers or ethylenically unsaturated monomers which include, for example, acrylamide-based and acrylate-based monomers. Suitably, the cationic polymer is selected from cationic vinyl addition polymers obtained by polymerising a cationic monomer or a monomer mixture comprising a cationic monomer represented by the general formula (II):

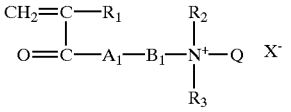

(II)

wherein $R_1$ is H or $CH_3$; $R_2$ and $R_3$ are each or, preferably, an alkyl group having from 1 to 3 carbon atoms, usually 1 to 2 carbon atoms; $A_1$ is O or NH; $B_1$ is an alkylene group having from 2 to 8 carbon atoms, suitably from 2 to 4 carbon atoms, or a hydroxy propylene group; Q is a substituent containing an aromatic group, suitably a phenyl or substituted phenyl group, which can be attached to the nitrogen by means of an alkylene group usually having from 1 to 3 carbon atoms, suitably 1 to 2 carbon atoms, and preferably Q is a benzyl group ($—CH_2—C_6H_5$); and $X^-$ is an anionic counterion, usually a halide like chloride. Examples of suitable monomers represented by the general formula (II) include quaternary monomers obtained by treating dialkylaminoalkyl (meth)acrylates, e.g. dimethylaminoethyl (meth)-acrylate, diethylaminoethyl (meth)acrylate and dimethylaminohydroxypropyl (meth)acrylate, and dialkylaminoalkyl (meth)acrylamides, e.g. dimethylaminoethyl (meth) acrylamide, diethyl-aminoethyl (meth)acrylamide, dimethylaminopropyl (meth)acrylamide, and diethylaminopropyl (meth)acrylamide, with benzyl chloride. Preferred cationic monomers of the general formula (II) include dimethylaminoethylacrylate benzyl chloride quaternary salt and dimethylaminoethylmethacrylate benzyl chloride quaternary salt.

The cationic vinyl addition (synthetic cationic) polymer can be a homopolymer prepared from a cationic monomer having an aromatic group or a copolymer prepared from a monomer mixture comprising a cationic monomer having an aromatic group and one or more copolymerizable monomers. Suitable copolymerizable non-ionic monomers include monomers represented by the general formula (III):

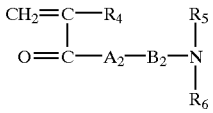

(III)

wherein $R_4$ is H or $CH_3$; $R_5$ and R6 are each H or a hydrocarbon group, suitably alkyl, having from 1 to 6, suitably from 1 to 4 and usually from 1 to 2 carbon atoms; $A_2$ is O or NH; $B_2$ is an alkylene group of from 2 to 8 carbon atoms, suitably from 2 to 4 carbon atoms, or a hydroxy propylene group or, alternatively, A and B are both nothing whereby there is a single bond between C and N ($O{=}C—NR_5R_6$). Examples of suitable copolymerizable monomers of this type include (meth)acrylamide; acrylamide-based monomers like N-alkyl (meth)acrylamides and N,N-dialkyl (meth)acrylamides, e.g. N-n-propylacrylamide, N-isopropyl (meth)acrylamide, N-n-butyl (meth)acrylamide, N-isobutyl (meth)acrylamide and N-t-butyl (meth)acrylamide; and dialkylaminoalkyl (meth)acrylamides, e.g. dimethylaminoethyl (meth)acrylamide, diethylaminoethyl (meth) acrylamide, dimethylaminopropyl (meth)acryl-amide and diethylaminopropyl (meth)acrylamide; acrylate-based monomers like dialkyl-aminoalkyl (meth)acrylates, e.g. dimethylaminoethyl (meth)acrylate, diethylaminoethyl (meth)acrylate, t-butylaminoethyl (meth)acrylate and dimethylaminohydroxypropyl acrylate; and vinylamides, e.g. N-vinylformamide and N-vinylacetamide. Preferred copolymerizable non-ionic monomers include acrylamide and methacrylamide, i.e. (meth)acrylamide, and the main polymer is preferably an acrylamide-based polymer.

Suitable copolymerizable cationic monomers include the monomers represented by the general formula (IV):

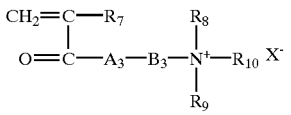

(IV)

wherein $R_7$ is H or $CH_3$; $R_8$, $R_9$ and $R_{10}$ are each H or, preferably, a hydrocarbon group, suitably alkyl, having from 1 to 3 carbon atoms, usually 1 to 2 carbon atoms; $A_3$ is O or NH; $B_3$ is an alkylene group of from 2 to 4 carbon atoms, suitably from 2 to 4 carbon atoms, or a hydroxy propylene group, and $X^-$ is an anionic counterion, usually methylsulphate or a halide like chloride. Examples of suitable cationic copolymerizable monomers include acid addition salts and quaternary ammonium salts of the dialkylaminoalkyl (meth) acrylates and dialkyl-aminoalkyl (meth)acrylamides mentioned above, usually prepared using acids like HCl, $H_2SO_4$, etc., or quaternizing agents like methyl chloride, dimethyl sulphate, etc.; and diallyl-dimethylammonium chloride. Preferred copolymerizable cationic monomers include dimethylaminoethyl (meth)acrylate methyl chloride quaternary salt and diallyldimethyl-ammonium chloride. Copolymerizable anionic monomers like acrylic acid, methacrylic acid, various sulfonated vinyl addition monomers, etc. can also be employed and, preferably, in minor amounts.

The cationic vinyl addition polymer can be prepared from a monomer mixture generally comprising from 1 to 99 mole %, suitably from 2 to 50 mole % and preferably from 5 to 20 mole % of cationic monomer having an aromatic group, preferably represented by the general formula (II), and from 99 to 1 mole %, suitably from 98 to 50 mole %, and preferably from 95 to 80 mole % of other copolymerizable monomers which preferably comprises acrylamide or methacrylamide ((meth)acrylamide), the monomer mixture suitably comprising from 98 to 50 mole % and preferably from 95 to 80 mole % of (meth)acrylamide, the sum of percentages being 100.

The cationic polymer can also be selected from polymers prepared by condensation reaction of one or more monomers containing an aromatic group. Examples of such monomers include toluene diisocyanates, bisphenol A, phthalic acid, phthalic anhydride, etc., which can be used in the preparation of cationic polyurethanes, cationic polyamideamines, etc.

Alternatively, the organic polymer can be a polymer subjected to aromatic modification using an agent containing an aromatic group. Suitable modifying agents of this type include benzyl chloride, benzyl bromide, N-(3-chloro-2-hydroxypropyl)-N-benzyl-N,N-dimethylammonium chloride, and N-(3-chloro-2-hydroxypropyl) pyridinium chloride. Suitable polymers for such an aromatic modification include vinyl addition polymers. If the polymer contains a tertiary nitrogen which can be quaternized by the modifying agent, the use of such agents usually results in that the polymer is rendered cationic. Alternatively, the polymer to be subjected to aromatic modification can be cationic, for example a cationic vinyl addition polymer.

Usually the charge density of the vinyl addition polymer is within the range of from 0.1 to 6.0 meqv/g of dry polymer, suitably from 0.2 to 4.0 and preferably from 0.5 to 3.0. The weight average molecular weight of synthetic polymers is usually at least about 500,000, suitably above about 1,000,000 and preferably above about 2,000,000. The upper limit is not critical; it can be about 50,000,000, usually 30,000,000 and suitably 25,000,000.

Anionic Polymer Having One or More Aromatic Groups

The anionic polymer having an aromatic group comprised in the sizing promoter and optionally comprised in the sizing dispersion of the present invention is a step-growth polymer, a polysaccharide or a naturally occurring aromatic polymer. The term "step-growth polymer", as used herein, refers to a polymer obtained by step-growth polymerization, also being referred to as step-reaction polymer and step-reaction polymerization, respectively. Preferably, the anionic polymer comprised in the promoter is a step-growth polymer, a polysaccharide or a naturally occurring aromatic polymer with the proviso that the anionic polymer is not a melamine sulphonic acid condensation polymer. The anionic polymer may be a step-growth polymer or a naturally occurring aromatic polymer. The anionic polymers according to the invention can be linear, branched or cross-linked. The anionic polymer is commonly water-soluble or water-dispersable. The anionic polymer is preferably organic. Preferred anionic aromatic polymers are naphthalene sulphonate condensation polymers like condensated naphthalene sulphonate, and modified lignin polymers, e.g. lignin sulphonate.

The aromatic group of the anionic polymer can be present in the polymer backbone or in a substituent group that is attached to the polymer backbone (main chain). Examples of suitable aromatic groups include aryl, aralkyl and alkaryl groups and derivatives thereof, e.g. phenyl, tolyl, naphthyl, phenylene, xylylene, benzyl, phenylethyl and derivatives of these groups. Examples of anionically charged groups that can be present in the anionic polymer as well as in the monomers used for preparing the anionic polymer include groups carrying an anionic charge and acid groups carrying an anionic charge when dissolved or dispersed in water, the groups herein collectively being referred to as anionic groups, such as phosphate, phosphonate, sulphate, sulphonic acid, sulphonate, carboxylic acid, carboxylate, alkoxide and phenolic groups, i.e. hydroxy-substituted phenyls and naphthyls. Groups carrying an anionic charge are usually salts of an alkali metal, alkaline earth or ammonia.

Examples of suitable anionic step-growth polymerization products according to the present invention include condensation polymers, i.e. polymers obtained by step-growth condensation polymerization, e.g. condensates of an aldehyde such as formaldehyde with one or more aromatic compounds containing one or more anionic groups, specifically condensated naphthalene sulphonate type polymers, and optional other co-monomers useful in the condensation polymerization such as urea. Examples of suitable aromatic compounds containing anionic groups include phenolic and naphtholic compounds such as phenol, naphthol, resorcinol and derivatives thereof, aromatic acids and salts thereof such as phenylic, phenolic, naphthylic and naphtholic acids and salts, usually sulphonic acids and sulphonates, e.g. benzene sulphonic acid and sulphonate, xylen sulphonic acid and sulphonates, naphthalene sulphonic acid and sulphonate, phenol sulphonic acid and sulphonate.

Examples of further suitable anionic step-growth polymerization products according to the present invention include addition polymers, i.e. polymers obtained by step-growth addition polymerization, e.g. anionic polyurethanes prepared from a monomer mixture comprising aromatic isocyanates and/or aromatic alcohols. Examples of suitable aromatic isocyanates include diisocyanates, e.g. toluene-2,4- and 2,6-diisocyanates and diphenyl-methane-4,4'-diisocyanate. Examples of suitable aromatic alcohols include dihydric alcohols, i.e. diols, e.g. bisphenol A, phenyl diethanol amine, glycerol monoterephthalate and trimethylolpropane monoterephthalate. Monohydric aromatic alcohols such as phenol and derivaties thereof may also be employed. The monomer mixture can also contain non-aromatic isocyanates and/or alcohols, usually diisocyanates and diols, for example any of those known to be useful in the preparation of polyurethanes. Examples of suitable monomers containing anionic groups include the monoester reaction products of triols, e.g. trimethylolethane, trimethylolpropane and glycerol, with dicarboxylic acids or anhydrides thereof, e.g. succinic acid and anhydride, terephthalic acid and anhydride, such as glycerol monosuccinate, glycerol monoterephthalate, trimethylolpropane monosuccinate, trimethylolpropane monoterephthalate, N,N-bis-(hydroxyethyl)-glycine, di-(hydroxy-methyl)propionic acid, N,N-bis-(hydroxyethyl)-2-aminoethanesulfonic acid, and the like, optionally and usually in combination with reaction with a base, such as alkali metal and alkaline earth hydroxides, e.g. sodium hydroxide, ammonia or an amine, e.g. triethylamine, thereby forming an alkali metal, alkaline earth or ammonium counter-ion.

Examples of suitable anionic chain-growth polymerization products according to the invention include anionic vinyl addition polymers obtained from a mixture of vinylic or ethylenically unsaturated monomers comprising at least one monomer having an aromatic group and at least one monomer having an anionic group, usually co-polymerized with non-ionic monomers such as acrylate- and acrylamide-based monomers. Examples of suitable anionic monomers include (meth)acrylic acid and paravinyl phenol (hydroxy styrene).

Examples of suitable anionic polysaccharides include starches, guar gums, celluloses, chitins, chitosans, glycans, galactans, glucans, xanthan gums, pectins, mannans, dextrins, preferably starches, guar gums and cellulose derivatives, suitable starches including potato, corn, wheat, tapioca, rice, waxy maize and barley, preferably potato. The anionic groups in the polysaccharide can be native and/or introduced by chemical treatment. The aromatic groups in the polysaccharide can be introduced by chemical methods known in the art.

Examples of suitable (modified) naturally occurring aromatic anionic polymers of this invention include Kraft lignin, such as modified lignin polymers like lignin adducts co-polymerised with formaldehyde and sulphonated lignin, e.g. lignin sulphonate and tannin extracts, i.e. naturally occuring polyphenolic substances that are present in the organic extracts of bark of some wood species.

Suitably, the anionic polymer having an aromatic group is selected from step-growth polymers, polysaccharides and naturally occurring aromatic polymer. Condensated naphthalene sulphonate type polymers like condesated naphthalene sulphonate and modified lignin polymers such as lignin sulphonates are preferred.

The weight average molecular weight of the anionic polymer can vary within wide limits dependent on, inter alia, the type of polymer used, and usually it is at least about 500, suitably above about 2,000 and preferably above about 5,000. The upper limit is not critical; it can be about 200,000,000, usually 150,000,000, suitably 100,000,000 and preferably 1,000,000.

The anionic polymer can have a degree of anionic substitution ($DS_A$) varying over a wide range dependent on, inter alia, the type of polymer used; $DS_A$ is usually from 0.01 to 2.0, suitably from 0.02 to 1.8 and preferably from 0.025 to 1.5; and the degree of aromatic substitution ($DS_Q$) can be from 0.001 to 1.0, usually from 0.01 to 0.8, suitably from 0.02 to 0.7 and preferably from 0.025 to 0.5. In case the anionic polymer contains cationic groups, the degree of cationic substitution ($DS_c$) can be, for example, from 0 to 0.2, suitably from 0 to 0.1 and preferably from 0 to 0.05, the anionic polymer having an overall anionic charge. Usually the anionic charge density of the anionic polymer is within the range of from 0.1 to 6.0 meqv/g of dry polymer, suitably from 0.5 to 5.0 and preferably from 1.0 to 4.0.

The cationic organic polymer having an aromatic group and the anionic polymer having an aromatic group of the sizing promoter can be added to the aqueous suspension (stock) in any order separately from the addition of the sizing dispersion and in amounts which can vary within wide limits depending on, inter alia, type of stock, salt content, type of salts, filler content, type of filler, point of addition, etc. Generally the polymers are added in an amount that give better sizing than is obtained when not adding them and usually the cationic organic polymer is added to the stock prior to adding the anionic polymer. The cationic polymer is usually added in an amount of at least 0.001%, often at least 0.005% by weight, based on dry stock substance, whereas the upper limit is usually 3% and suitably 2.0% by weight. The anionic polymer is usually added in an amount of at least 0.001%, often at least 0.005% by weight, based on dry stock substance, whereas the upper limit is usually 3% and suitably 1.5% by weight.

Apart from the cationic organic polymer and the anionic polymer the sizing promoter may contain other compounds which improve the sizing efficiency such as anionic microparticulate materials, e.g., silica-based particles and clays of smectite type, low molecular weight cationic organic polymers, aluminium compounds like alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates and mixtures thereof, anionic vinyl addition polymers and combinations thereof.

The process of the invention is preferably used in the manufacture of paper from a suspension containing cellulosic fibres, and optional fillers, having a high conductivity. Usually, the conductivity of the stock is at least 0.20 mS/cm, suitably at least 0.5 mS/cm, preferably at least 3.5 mS/cm. Very good sizing results have been observed at conductivity levels above 5.0 mS/cm and even above 7.5 mS/cm. Conductivity can be measured by standard equipment such as, for example a WTW LF 539 instrument supplied by Christian Berner. The values referred to above are suitably determined by measuring the conductivity of the cellulosic suspension that is fed into or present in the headbox of the paper machine or, alternatively, by measuring the conductivity of white water obtained by dewatering the suspension. High conductivity levels mean high contents of salts (electrolytes), where the various salts can be based on mono-, di- and multivalent cations like alkali metals, e.g. $Na^+$ and $K^+$, alkaline earths, e.g. $Ca^{2+}$ and $Mg^{2+}$, aluminium ions, e.g. $Al^{3+}$, $Al(OH)^{2+}$ and polyaluminium ions, and mono-, di- and multivalent anions like halides, e.g., $Cl^-$, sulfates, e.g. $SO_4^{2-}$ and $HSO_4^-$, carbonates, e.g. $CO_3^{2-}$ and $HCO_3^-$, silicates and lower organic acids. The invention is particularly useful in the manufacture of paper from stocks having high contents of salts of di- and multivalent cations, and usually the cation content is at least 200 ppm, suitably at least 300 ppm and preferably at least 400 ppm. The salts can be derived from the cellulosic fibres and fillers used to form the stock, in particular in integrated mills where a concentrated aqueous fibre suspension from the pulp mill normally is mixed with water to form a dilute suspension suitable for paper manufacture in the paper mill. The salt may also be derived from various additives introduced into the stock, from the fresh water supplied to the process, or be added deliberately, etc. Further, the content of salts is usually higher in processes where white water is extensively recirculated, which may lead to considerable accumulation of salts in the water circulating in the process.

The present invention further encompasses papermaking processes where white water is extensively recirculated (recycled), i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recirculation of white water obtained in the process suitably comprises mixing the white water with cellulosic fibres and/or optional fillers to form a suspension to be sized; preferably it comprises mixing the white water with a suspension containing cellulosic fibres, and optional fillers, before the suspension enters the forming wire for sizing.

Further additives which are conventional in papermaking can of course be used in combination with the additives according to the invention, such as, for example, additional dry strength agents, wet strength agents. The cellulosic suspension, or stock, can also contain mineral fillers of conventional types such as, for example, kaolin, china clay, titanium dioxide, gypsum, talc and natural and synthetic calcium carbonates such as chalk, ground marble and precipitated calcium carbonate.

The process of this invention is used for the production of paper. The term "paper", as used herein, of course include not only paper and the production thereof, but also other sheet or web-like products, such as for example board and paperboard, and the production thereof. The process can be used in the production of paper from different types of suspensions of cellulose-containing fibres and the suspensions should suitably contain at least 25% by weight and preferably at least 50% by weight of such fibres, based on dry substance. The suspensions can be based on fibres from chemical pulp such as sulphate, sulphite and organosolv pulps, mechanical pulp such as thermome-chanical pulp, chemo-thermomechanical pulp, refiner pulp and groundwood pulp, from both hardwood and softwood, and can also be based on recycled fibres, optionally from de-inked pulps, and mixtures thereof. The invention is particularly useful in the manufacture of paper from suspensions based on pulps comprising recycled fibres and de-inked pulp, and the content of cellulosic fibres of such origin can be up to 100%, suitably from 20% to 100%.

The invention is further illustrated in the following Examples which, however, are not intended to limit the same. Parts and % relate to parts by weight and % by weight, respectively, unless otherwise stated.

In all examples hereinafter the sizing dispersion and the sizing prompter were added separately to the cellulosic suspension. Furthermore, in the case the promoter comprised more than one polymer having an aromatic group, these polymers were added separately to the suspension with respect to each other and to the dispersion.

EXAMPLE 1

The sizing performance of the process was evaluated by using the cobb 60 test. An anionic sizing dispersion was prepared containing alkyl ketene dimer, condensated naphthalene sulphonate and di(hydrogenated tallow) dimethylammonium chloride. The sizing dispersion had an AKD content of 30% and contained 4% of di(hydrogenated tallow) dimethylammonium chloride and 6% of condensated naphthalene sulphonate based on AKD. The sizing dispersion was added to the stock in an amount of 5 kg AKD/tonne dry stock.

In test 2 the sizing promoter comprised condensated naphtalene sulphonate (available under the trade name Tamol®) and a cationic starch with a cationic substitution DS of 0.065 regarding nitrogen containing benzyl groups. In test 1 cationic starch without aromatic groups with a cationic substitution of 0.065 and anionic inorganic silica particles provided as a sol, i.e. an anionic non-aromatic polymer, was added to the furnish.

The furnish used was based on 80% by weight of bleached birch/pine (60/40) sulphate pulp and 20% by weight of $CaCO_3$ refined to 200 CSF and containing 0.3 g/liter stock $Na_2SO_4$, having a conductivity of 461 $\mu$S/cm and a pH of 8,1.

TABLE 1

| Test no. | anionic sizing dispersion/ [kg sizing agent/tonne dry stock] | cationic starch containing aromatic groups/ [kg/tonne dry stock] | cationic starch (without aromatic groups)/[kg starch/tonne dry stock] |
|---|---|---|---|
| test 1 | 0.5 | 0 | 10 |
| test 2 | 0.5 | 10 | 0 |

| Test no. | cond. naphtalene sulphonate/[kg cond./tonne dry stock] | anionic silica particles/[kg silica part./tonne dry stock] | cobb 60/[g/m$^2$] |
|---|---|---|---|
| test 1 | 0 | 1 | 45.2 |
| test 2 | 1 | 0 | 29.3 |

EXAMPLE 2

The sizing performance of the process was evaluated (cobb 60 test) by adding the same anionic sizing dispersion as described in example 1 and a sizing promoter comprising cationic starch with a cationic substitution DS of 0.065 regarding nitrogen containing benzyl groups and anionic inorganic silica particles (test 1); and a promoter comprising condensated naphtalene sulphonate (available under the trade name Tamol ®) and a cationic starch with a cationic substitution DS of 0.065 regarding nitrogen containing benzyl groups (test 2). However, calcium chloride was added to the furnish to adjust the conductivity to 5000 $\mu$S/cm thereby simulating a furnish having high conductivity.

TABLE 2

| Test no. | anionic sizing dispersion/ [kg sizing agent/tonne dry stock] | cationic starch containing aromatic groups/ [kg/tonne dry stock] | cationic starch (without aromatic groups)/[kg starch/tonne dry stock] |
|---|---|---|---|
| test 1 | 0.5 | 10 | 0 |
| test 2 | 0.5 | 10 | 0 |

| Test no. | cond. naphtalene sulphonate/[kg cond./tonne dry stock] | anionic silica particles/[kg silica part./tonne dry stock] | cobb 60/[g/m$^2$] |
|---|---|---|---|
| test 1 | 0 | 1 | 75 |
| test 2 | 1 | 0 | 27.8 |

EXAMPLE 3

The sizing performance was evaluated using a cationic sizing dispersion which contained 15% of alkyl ketene dimer, 2% of cationic starch and 0.6% of sodium lignosulphonte, based on AKD. The components and added amount of components comprised in the sizing promoter, apparent from table 3, included condensated naphtalene sulphonate, cationic starch without aromatic groups having a DS of 0.065, cationic starch containing aromatic groups having a DS of 0.065 and anionic inorganic silica particles provided as a sol. The stock used was that of example 2 having a pH of 8.1 and a conductivity of 5000 $\mu$S/cm by the addition of calcium chloride to the stock.

TABLE 3

| Test no. | cationic sizing dispersion/ [kg sizing agent/tonne dry stock] | cationic starch containing aromatic groups/ [kg/tonne dry stock] | cationic starch (without aromatic groups)/[kg starch/tonne dry stock] |
|---|---|---|---|
| test 1 | 0.5 | 0 | 10 |
| test 2 | 0.5 | 10 | 0 |

| Test no. | cond. naphtalene sulphonate/[kg cond./tonne dry stock] | anionic silica particles/[kg silica part./tonne dry stock] | cobb 60/[g/m$^2$] |
|---|---|---|---|
| test 1 | 0 | 1 | 55 |
| test 2 | 1 | 0 | 27.8 |

EXAMPLE 4

An anionic sizing dispersion was prepared containing 8,9% of a commercial alkyl ketene dimer, 0,89% of an aromat substituted cationic starch having a DS of 0,065 containing benzyl groups, and 0,22% of condensated naphthalene sulphonate available under the trade name Tamol ®. The anionic dispersion was added in an amount of 0,0115% (dry base) based on the ketene dimer to a cellulosic suspension (dry base) containing 30% Pine, 30% Bee, 40% Eucaluptus, and 15% of precipitated $CaCO_3$. The conductivity of the suspension was 500 $\mu$S/cm. To the suspension was also added a sizing promoter containing benzyl substituted starch having a DS of 0.065 and condensated naphtalene sulphonate available under the trade name Tamol® (test 2).

To the same suspension was also added the same anionic dispersion. However, the sizing promoter added to the suspension contained no aromatic polymers. The sizing promoter contained cationic starch with a DS of 0.065 having no aromatic groups and anionic inorganic silica particles provided as a sol (test 1). The amounts of polymers of the promoter and sizing agent (AKD) of the dispersion are given in table 4.

TABLE 4

| Test no. | anionic sizing dispersion/ [kg sizing agent/tonne dry stock] | cationic starch containing aromatic groups/[kg /tonne dry stock] | cationic starch (without aromatic groups)/[kg starch/tonne dry stock] |
|---|---|---|---|
| test 1 | 0.115 | 0 | 5 |
| test 1 | 0.125 | 0 | 5 |
| test 1 | 0.140 | 0 | 5 |
| test 2 | 0.115 | 5 | 0 |
| test 2 | 0.125 | 5 | 0 |
| test 2 | 0.140 | 5 | 0 |

| Test no. | cond. naphtalene sulphonate/ [kg cond./tonne dry stock] | anionic silica particles/[kg silica part./tonne dry stock] | cobb 60/[g/m$^2$] |
|---|---|---|---|
| test 1 | 0 | 0.120 | 90.0 |
| test 1 | 0 | 0.120 | 50.0 |
| test 1 | 0 | 0.120 | 29.0 |
| test 2 | 0.120 | 0 | 28.0 |
| test 2 | 0.120 | 0 | 27.0 |
| test 2 | 0.120 | 0 | 25.5 |

EXAMPLE 5

In this example the same dispersion and sizing promoters were used as in example 2 except that the conductivity of the suspension was 5000 $\mu$S/cm.

The amounts of polymers of the promoter and sizing agent (AKD) of the dispersion are given in table 5.

TABLE 5

| Test no. | anionic sizing dispersion/ [kg sizing agent/tonne dry stock] | cationic starch containing aromatic groups/[kg /tonne dry stock] | cationic starch (without aromatic groups)/[kg starch/tonne dry stock] |
|---|---|---|---|
| test 1 | 0.140 | 0 | 5 |
| test 1 | 0.160 | 0 | 5 |
| test 1 | 0.180 | 0 | 5 |
| test 1 | 0.200 | 0 | 5 |
| test 2 | 0.100 | 5 | 0 |
| test 2 | 0.115 | 5 | 0 |
| test 2 | 0.125 | 5 | 0 |
| test 2 | 0.140 | 5 | 0 |

| Test no. | cond. naphtalene sulphonate/ [kg cond./tonne dry stock] | anionic silica particles/[kg silica part./tonne dry stock] | cobb 60/[g/m$^2$] |
|---|---|---|---|
| test 1 | 0 | 0.120 | 150 |
| test 1 | 0 | 0.120 | 137 |
| test 1 | 0 | 0.120 | 138 |
| test 1 | 0 | 0.120 | 110 |
| test 2 | 0.120 | 0 | 47 |
| test 2 | 0.120 | 0 | 35 |

TABLE 5-continued

| | | | |
|---|---|---|---|
| test 2 | 0.120 | 0 | 33 |
| test 2 | 0.120 | 0 | 25 |

EXAMPLE 6

The sizing performance of the process was evaluated by using the Cobb 60 test. An anionic sizing dispersion was prepared containing alkyl ketene dimer, condensed naphtalene sulphonate and di(hydrogenated tallow) dimethylammonium chloride. The sizing dispersion had an AKD content of 30% and contained 4% of di(hydrogenated tallow) dimethylammonium chloride and 6% of condensed naphtalene sulphonate, based on AKD. The sizing dispersion was added in an amount of 0.3 kg AKD/tonne of dry stock.

A cationic starch with a cationic substitution DS of 0.065 regarding nitrogen containing benzylgruops and a starch with a cationic substitution DS of 0.065 were used in a combination of a condensed naphtalene sulphonate and a melamin sulphonate, respectively.

The furnish used was based on 80% birch/pine (60/40) sulphate pulp and 20% by weight oc $CaCO_3$, refinded to 200 CSF and containing 0.3 g/litre stock giving a conductivity of 555 $\mu$S/cm and a pH 8,22.

TABLE 6

| Test no. | Anionic sizing dispersion kg/tonne of sizing agent/tonne of dry stock | Cationic starch containing aromatic groups kg/tonne of dry pulp | Cationic starch without aromatic groups kg/tonne of dry pulp |
|---|---|---|---|
| Test 1 | 0.3 | 10 | |
| Test 2 | 0.3 | 10 | |
| Test 3 | 0.3 | | 10 |
| Test 4 | 0.3 | | 10 |

| Test no. | cond. naphtalen sulphonate kg/tonne of dry pulpl | melamin sulphonate kg/tonne of dry pulp | Cobb 60 g/m$^2$ |
|---|---|---|---|
| Test 1 | 1 | | 33 |
| Test 2 | | 1 | 52 |
| Test 3 | 1 | | 35 |
| Test 4 | | 1 | 68 |

What is claimed is:

1. A process for sizing paper which comprises adding to an aqueous suspension containing cellulosic fibres, and optional fillers, (i) an anionic or cationic sizing dispersion; and (ii) a sizing promoter comprising a cationic organic polymer having one or more aromatic groups, and an anionic polymer having one or more aromatic groups, the anionic polymer being a step-growth polymer, a polysaccharide or a naturally occurring aromatic polymer, forming and draining the obtained suspension, wherein the sizing dispersion and sizing promoter are added separately to the aqueous suspension.

2. The process according to claim 1, wherein the cationic organic polymer and the anionic polymer comprised in the sizing promoter are added separately to the aqueous suspension.

3. The process according to claim 1, wherein the anionic polymer having an aromatic group comprised in the sizing promoter is added to the aqueous suspension after both the sizing dispersion and the cationic organic polymer having an aromatic group comprised in the sizing promoter.

4. The process according to claim 1, wherein the sizing dispersion comprises a cellulose-reactive sizing agent.

5. The process according to claim 1, wherein the sizing dispersion comprises ketene dimers or acid anhydrides.

6. The process according to claim 1, wherein the sizing dispersion comprises acid anhydrides.

7. The process according to claim 1, wherein the cationic organic polymer is a cationic polysaccharide or a cationic vinyl addition polymer.

8. The process according to claim 1, wherein the cationic organic polymer is a cationic polysaccharide having the structural formula (I):

(I)

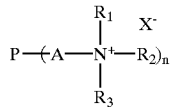

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion; and/or vinyl addition polymers obtained by polymerising a cationic monomer or a monomer mixture comprising a cationic monomer represented by the general formula (II):

(II)

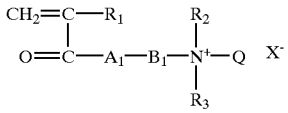

wherein $R_1$ is H or $CH_3$; $R_2$ and $R_3$ are each an alkyl group having from 1 to 3 carbon atoms, $A_1$ is O or NH, $B_1$ is an alkylene group having from 2 to 8 carbon atoms or a hydroxy propylene group, Q is a substituent containing an aromatic group, and $X^-$ is an anionic counter ion.

9. The process according to claim 1, wherein the cationic organic polymer is selected from cationic polysaccharides.

10. The process according to claim 1, wherein the cationic organic polymer is selected from cationic starch.

11. The process according to claim 1, wherein the cationic polymer is selected from cationic polysaccharides having the structural formula (I):

(I)

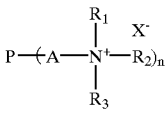

wherein P is a residue of a polysaccharide: A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion.

12. The process according to claim 11, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

13. The process according to claim 1, wherein the anionic polymer is a step-growth polymer or a naturally occurring aromatic polymer.

14. The process according to claim 1, wherein the anionic polymer is a naphthalene sulphonate condensation polymer or modified lignin polymer.

15. The process according to claim 1, wherein the anionic polymer having an aromatic group is condesated naphthalene sulphonate or lignin sulphonate.

16. The process according to claim 1, wherein the conductivity of the suspension is at least 4.5 mS/cm.

17. A process for sizing paper which comprises adding to an aqueous suspension containing cellulosic fibres, and optional fillers, (i) an anionic or cationic sizing dispersion comprising a sizing agent and an anionic polymer having one or more aromatic groups being a step-growth polymer, a polysaccharide or a naturally occurring aromatic polymer, the amount of added sizing dispersion to the suspension being from about 0.01% up to about 5.0% by weight calculated as sizing agent based on dry fibres; and (ii) a sizing promoter comprising a cationic organic polymer having one or more aromatic groups, and an anionic polymer having one or more aromatic groups being a step-growth polymer, a polysaccharide or a naturally occurring aromatic polymer; the amount of cationic polymer added to the suspension being from about 0.001% up to about 3% by weight based on dry fibre, and the amount of anionic polymer added to the suspension being from about 0.001% up to about 3% by weight based on dry fibre, forming and draining the obtained suspension, wherein the sizing dispersion and sizing promoter are added separately to the aqueous suspension.

18. The process according to claim 17, wherein the cationic organic polymer is a cationic polysaccharide or a cationic vinyl addition polymers.

19. The process according to claim 18, wherein the cationic organic polymer is a cationic polysaccharide having the structural formula (I):

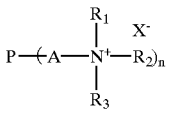

(I)

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion; or a vinyl addition polymer obtained by polymerising a cationic monomer or a monomer mixture comprising a cationic monomer represented by the general formula (II):

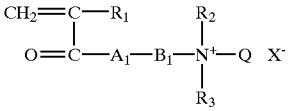

(II)

wherein $R_1$ is H or $CH_3$; $R_2$ and $R_3$ are each an alkyl group having from 1 to 3 carbon atoms, $A_1$ is 0 or NH, $B_1$ is an alkylene group having from 2 to 8 carbon atoms or a hydroxy propylene group, Q is a substituent containing an aromatic group, and $X^-$ is an anionic counter ion.

20. The process according to claim 17, wherein the cationic organic polymer is cationic polysaccharide.

21. The process according to claim 20, wherein the cationic organic polymer is a cationic polysaccharide having the structural formula (I):

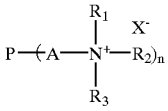

(I)

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion.

22. The process according to claim 21, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

23. The process according to claim 17, wherein the anionic polymer is a step-growth polymer or naturally occurring aromatic polymer.

24. The process according to claim 23, wherein the anionic polymer is a naphthalene sulphonate condensation polymer or modified lignin polymer.

25. The process according to claim 24, wherein the anionic polymer is condesated naphthalene sulphonate or lignin sulphonate.

26. The process according to claim 17, wherein the sizing agent is a cellulose-reactive sizing agent.

27. The process according to claim 26, wherein the sizing agent is ketene dimer or acid anhydride.

28. The process according to claim 26, wherein the sizing agent is acid anhydride.

29. The process according to claim 17, wherein the conductivity of the suspension is at least 4.5 mS/cm.

30. The process according to claim 17, wherein the cationic organic polymer and the anionic polymer comprised in the sizing promoter are added separately to the aqueous suspension.

31. The process according to claim 17, wherein the anionic polymer comprised in the sizing promoter is added to the aqueous suspension after both the sizing dispersion and the cationic organic polymer comprised in the sizing promoter.

32. A process for sizing paper which comprises adding to an aqueous suspension containing cellulosic fibres, and optional fillers, (i) an anionic or cationic sizing dispersion comprising a sizing agent, a cationic organic polymer having one or more aromatic groups and an anionic polymer having one or more aromatic groups being a step-growth polymer, a polysaccharide or a naturally occurring aromatic polymer, the amount of added sizing dispersion to the suspension being from about 0.01% up to about 5.0% by weight calculated as sizing agent based on dry fibres; and (ii) a sizing promoter comprising a cationic organic polymer having one or more aromatic groups, and an anionic polymer having one or more aromatic groups being a step-growth polymer, a polysaccharide or a naturally occurring aromatic polymer; the amount of cationic polymer added to the suspension being from about 0.001% up to about 3% by weight based on dry fibre, and the amount of anionic polymer added to the suspension being from about 0.001% up to about 3% by weight based on dry fibre, forming and draining the obtained suspension, wherein the sizing dispersion and sizing promoter are added separately to the aqueous suspension.

33. The process according to claim 32, wherein the cationic organic polymer of the sizing dispersion and sizing promoter is a cationic polysaccharide or a cationic vinyl addition polymer.

34. The process according to claim 33, wherein the cationic organic polymer of the sizing dispersion and sizing promoter is a cationic polysaccharide having the structural formula (I):

(I)

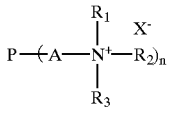

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion; or a vinyl addition polymer obtained by polymerising a cationic monomer or a monomer mixture comprising a cationic monomer represented by the general formula (II):

(II)

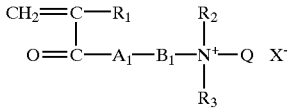

wherein $R_1$ is H or $CH_3$; $R_2$ and $R_3$ are each an alkyl group having from 1 to 3 carbon atoms, A1 is O or NH, $B_1$ is an alkylene group having from 2 to 8 carbon atoms or a hydroxy propylene group, Q is a substituent containing an aromatic group, and $X^-$ is an anionic counterion.

35. The process according to claim 32, wherein the cationic organic polymer of the sizing dispersion and sizing promoter is cationic polysaccharide.

36. The process according to claim 35, wherein the cationic organic polymer is a cationic polysaccharide having the structural formula (I):

(I)

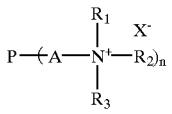

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion.

37. The process according to claim 36, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

38. The process according to claim 32, wherein the anionic polymer of the sizing dispersion and sizing promoter is a step-growth polymer or naturally occurring aromatic polymer.

39. The process according to claim 38, wherein the anionic polymer is a naphthalene sulphonate condensation polymer or a modified lignin polymer.

40. The process according to claim 39, wherein the anionic polymer is condesated naphthalene sulphonate or lignin sulphonate.

41. The process according to claim 32, wherein the sizing agent is a cellulosereactive sizing agent.

42. The process according to claim 32, wherein the conductivity of the suspension is at least 4.5 mS/cm.

43. The process according to claim 32, wherein the cationic organic polymer and the anionic polymer comprised in the sizing promoter are added separately to the aqueous suspension.

44. The process according to claim 32, wherein the anionic polymer comprised in the sizing promoter is added to the aqueous suspension after both the sizing dispersion and the cationic organic polymer comprised in the sizing promoter.

45. A process for sizing paper which comprises adding to an aqueous suspension containing cellulosic fibres, and optional fillers, (i) an anionic or cationic sizing dispersion comprising a sizing agent and an anionic polymer having one or more aromatic groups being a naphthalene sulphonate condensation polymer or a modified lignin polymer, the amount of added sizing dispersion to the suspension being from about 0.01% up to about 5.0% by weight calculated as sizing agent based on dry fibres; and (ii) a sizing promoter comprising a cationic organic polymer having one or more aromatic groups being a cationic polysaccharide, and an anionic polymer having one or more aromatic groups being a naphthalene sulphonate condensation polymer or a modified lignin polymer; the amount of cationic polymer added to the suspension being from about 0.001% up to about 3% by weight based on dry fibre, and the amount of anionic polymer added to the suspension being from about 0.001% up to about 3% by weight based on dry fibre, forming and draining the obtained suspension, wherein the sizing dispersion and sizing promoter are added separately to the aqueous suspension.

46. The process according to claim 45, wherein the cationic organic polymer is a cationic polysaccharide having the structural formula (I):

(I)

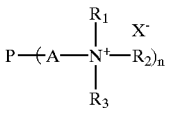

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion.

47. The process according to claim 46, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

48. The process according to claim 45, wherein the anionic polymer of the sizing dispersion and promoter is condensated naphthalene sulphonate or lignin sulphonate.

49. The process according to claim 45, wherein the sizing agent is a cellulose-reactive sizing agent.

50. The process according to claim 45, wherein the conductivity of the suspension is at least 4.5 mS/cm.

51. The process according to claim 45, wherein the cationic organic polymer and the anionic polymer comprised in the sizing promoter are added separately to the aqueous suspension.

52. The process according to claim 45, wherein the anionic polymer comprised in the sizing promoter is added to the aqueous suspension after both the sizing dispersion and the cationic organic polymer comprised in the sizing promoter.

53. A process for sizing paper which comprises adding to an aqueous suspension containing cellulosic fibres, and optional fillers, (i) an anionic or cationic sizing dispersion comprising a sizing agent, a cationic organic polymer having one or more aromatic groups being a cationic polysaccharide, and an anionic polymer having one or more aromatic groups being a naphthalene sulphonate condensation polymer or a modified lignin polymer, the amount of added sizing dispersion to the suspension being from about 0.01% up to about 5.0% by weight calculated as sizing agent based on dry fibres; and (ii) a sizing promoter comprising a cationic organic polymer having one or more aromatic groups being a cationic polysaccharide, and an anionic polymer having one or more aromatic groups being a naphthalene sulphonate condensation polymer or a modified lignin polymer; the amount of cationic polymer added to the suspension being from about 0.001% up to about 3% by weight based on dry fibre, and the amount of anionic polymer added to the suspension being from about 0.001% up to about 3% by weight based on dry fibre, forming and draining the obtained suspension, wherein the sizing dispersion and sizing promoter are added separately to the aqueous suspension.

54. The process according to claim 53, wherein the cationic organic polymer of the sizing dispersion and promoter is a cationic polysaccharide having the structural formula (I)

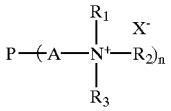

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion.

55. The process according to claim 54, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

56. The process according to claim 53, wherein the anionic polymer of the sizing dispersion and promoter is condensated naphthalene sulphonate or lignin sulphonate.

57. The process according to claim 53, wherein the sizing agent is a cellulose-reactive sizing agent.

58. The process according to claim 53, wherein the conductivity of the suspension is at least 4.5 mS/cm.

59. The process according to claim 53, wherein the cationic organic polymer and the anionic polymer comprised in the sizing promoter are added separately to the aqueous suspension.

60. The process according to claim 53, wherein the anionic polymer comprised in the sizing promoter is added to the aqueous suspension after both the sizing dispersion and the cationic organic polymer comprised in the sizing promoter.

61. A process for sizing paper which comprises adding to an aqueous suspension containing cellulosic fibres, and optional fillers, (i) an anionic or cationic sizing dispersion comprising a sizing agent and an anionic polymer having one or more aromatic groups being condensated naphthalene sulphonate or lignin sulphonate, the amount of added sizing dispersion to the suspension being from about 0.01% up to about 5.0% by weight calculated as sizing agent based on dry fibres; and (ii) a sizing promoter comprising a cationic organic polymer having one or more aromatic groups being a cationic polysaccharide having the structural formula (i)

(I)

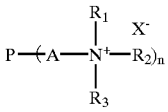

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion, and an anionic polymer having one or more aromatic groups being condensated naphthalene sulphonate or lignin sulphonate; the amount of cationic polymer added to the suspension being from about 0.001% up to about 3% by weight based on dry fibre, and the amount of anionic polymer added to the suspension being from about 0.001% up to about 3% by weight based on dry fibre, forming and draining the obtained suspension, wherein the sizing dispersion and sizing promoter are added separately to the aqueous suspension.

62. The process according to claim 61, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

63. The process according to claim 61, wherein the sizing agent is a cellulose-reactive sizing agent.

64. The process according to claim 61, wherein the conductivity of the suspension is at least 4.5 mS/cm.

65. The process according to claim 61, wherein the cationic organic polymer and the anionic polymer comprised in the sizing promoter are added separately to the aqueous suspension.

66. The process according to claim 61, wherein the anionic polymer comprised in the sizing promoter is added to the aqueous suspension after both the sizing dispersion and the cationic organic polymer comprised in the sizing promoter.

67. The process according to claim 61, wherein the sizing agent is present in the dispersion in an amount of from about 0.1 up to about 50% by weight based on total emulsion.

68. The process according to claim 61, wherein anionic polymer of the sizing dispersion is present in an amount of from about 0.1% up to about 15% by weight based on sizing agent.

69. The process according to claim 61, wherein cationic polymer of the sizing dispersion is present in an amount of from about 0.1% up to about 15% by weight based on sizing agent.

70. A process for sizing paper which comprises adding to an aqueous suspension containing cellulosic fibres, and optional fillers, (i) an anionic or cationic sizing dispersion comprising a sizing agent, a cationic organic polymer having one or more aromatic groups being a cationic polysaccharide having the structural formula (I):

(I)

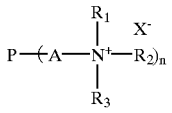

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion, and an anionic polymer having one or more aromatic groups being condensated naphthalene sulphonate or lignin sulphonate, the amount of added sizing dispersion to the suspension being from about 0.01% up to about 5.0% by weight calculated as sizing agent based on dry fibres; and (ii) a sizing promoter comprising a cationic organic polymer having one or more aromatic groups being a cationic polysaccharide having the structural formula (I):

(I)

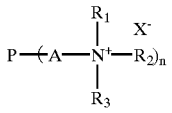

wherein P is a residue of a polysaccharide; A is a chain of atoms comprising C and H atoms attaching N to the polysaccharide residue, $R_1$ and $R_2$ are each H or a hydrocarbon group, $R_3$ is an aromatic hydrocarbon group, n is an integer from 2 up to 300000, and $X^-$ is an anionic counter ion, and an anionic polymer having one or more aromatic groups being condensated naphthalene sulphonate or lignin sulphonate; the amount of cationic polymer added to the suspension being from about 0.001% up to about 3% by weight based on dry fibre, and the amount of anionic polymer added to the suspension being from about 0.001% up to about 3% by weight based on dry fibre, forming and draining the obtained suspension, wherein the sizing dispersion and sizing promoter are added separately to the aqueous suspension.

71. The process according to claim 70, wherein A is an alkylene group with from 2 to 18 carbon atoms, optionally interrupted or substituted by one or more heteroatoms; $R_1$ and $R_2$ are each H or an alkyl group having from 1 to 3 carbon atoms; $R_3$ is a bezyl or phenylethyl group.

72. The process according to claim 70, wherein the sizing agent is a cellulose-reactive sizing agent.

73. The process according to claim 70, wherein the conductivity of the suspension is at least 4.5 mS/cm.

74. The process according to claim 70, wherein the cationic organic polymer and the anionic polymer comprised in the sizing promoter are added separately to the aqueous suspension.

75. The process according to claim 70, wherein the anionic polymer comprised in the sizing promoter is added to the aqueous suspension after both the sizing dispersion and the cationic organic polymer comprised in the sizing promoter.

76. The process according to claim 70, wherein the sizing agent is present in the dispersion in an amount of from about 0.1 up to about 50% by weight based on total emulsion.

77. The process according to claim 70, wherein anionic polymer of the sizing dispersion is present in an amount of from about 0.1% up to about 15% by weight based on sizing agent.

78. The process according to claim 70, wherein cationic polymer of the sizing dispersion is present in an amount of from about 0.1% up to about 15% by weight based on sizing agent.

* * * * *